US006935257B2

(12) United States Patent
Griffith

(10) Patent No.: US 6,935,257 B2
(45) Date of Patent: Aug. 30, 2005

(54) TUFT FEEDING MECHANISM

(75) Inventor: John D Griffith, Sunderland (GB)

(73) Assignee: Ulster Carpet Mills (Holdings) Limited, Craigavon (GB)

( * ) Notice: Subject to any disclaimer, the term of this patent is extended or adjusted under 35 U.S.C. 154(b) by 0 days.

(21) Appl. No.: 10/477,061

(22) PCT Filed: May 8, 2001

(86) PCT No.: PCT/GB01/01994

§ 371 (c)(1),
(2), (4) Date: Apr. 1, 2004

(87) PCT Pub. No.: WO02/090636

PCT Pub. Date: Nov. 14, 2002

(65) Prior Publication Data

US 2004/0173129 A1 Sep. 9, 2004

(51) Int. Cl.[7] ..... D05C 15/16
(52) U.S. Cl. ..... 112/80.73
(58) Field of Search ..... 112/80.73, 80.08, 112/80.16, 80.55, 80.5, 80.7, 80.71

(56) References Cited

U.S. PATENT DOCUMENTS 3,224,395 A * 12/1965 Card ..... 112/80.73
3,937,157 A 2/1976 Spanel
3,937,158 A 2/1976 Spanel
4,119,047 A 10/1978 Spanel
4,694,761 A * 9/1987 Golda ..... 112/80.71
6,202,580 B1 * 3/2001 Samilo ..... 112/80.73
6,401,639 B1 * 6/2002 Samilo ..... 112/80.73
6,725,789 B1 * 4/2004 Hall ..... 112/80.73

FOREIGN PATENT DOCUMENTS

| | | |
|---|---|---|
| EP | 0759101 | 2/1997 |
| GB | 2002828 | 2/1979 |
| WO | 01/79611 | 10/2001 |

* cited by examiner

*Primary Examiner*—Ismael Izaguirre
(74) *Attorney, Agent, or Firm*—Dann, Dorfman, Herrell and Skillman, P.C.; Henry H. Skillman

(57) ABSTRACT

A tuft forming mechanism including a yarn feed mechanism and a yarn severing means (6, 18), the yarn feed mechanism including a passage (5) along which yarn (2) is guided to said yarn severing means (6, 18) and an intermittently rotatable feed disc (1) which engages the yarn (2) to advance the yarn (2) along the passage (5).

11 Claims, 4 Drawing Sheets

TUFT FEEDING MECHANISM

FIELD OF INVENTION

The present invention relates to an apparatus and method of cutting yarn into tufts and feeding them into a carrier for use in particular, but not exclusively, in a gripper Axminister loom.

BACKGROUND OF THE INVENTION

Two known methods of feeding tufts into a carrier are described in EP 0 759 101 B1. In one method, yarn it transported down a tube by air. In practice, the airflow to achieve this needs to be so strong that it is turbulent on leaving the tube, making yarn exiting buffet and impossible to control to place in the carrier.

The second method show mechanical means of feeding the yarn. This is workable, but it involves complex mechanisms with a large number of wear parts, and is limited in speed by the requirement to move the feeder back to its start position and select it before feeding.

SUMMARY OF THE INVENTION

A general aim of the present invention is to provide a simple, reliable and fast way to feed tufts into the carrier.

According to one aspect of the invention there is provided a mechanism to feed yarn intermittently, cut it into lengths and place it into a carrier. The mechanism includes an intermittently rotating toothed feed disc driven a by a motor, a stream of air to keep it straight as it is pushed down a passage, a cutter, and a carrier which picks up the cut lengths by pressing it into an anvil.

Preferably the motor is electronically controlled to feed a pre-set length of yarn only when required. Suitable motors for example could be a stepper motor or a servo motor.

BRIEF DESCRIPTION OF THE DRAWINGS

Various aspects of the present invention are hereinafter described with reference to the accompanying drawings, in which.

DESCRIPTION OF THE PREFERRED EMBODIMENTS

Figure 1:
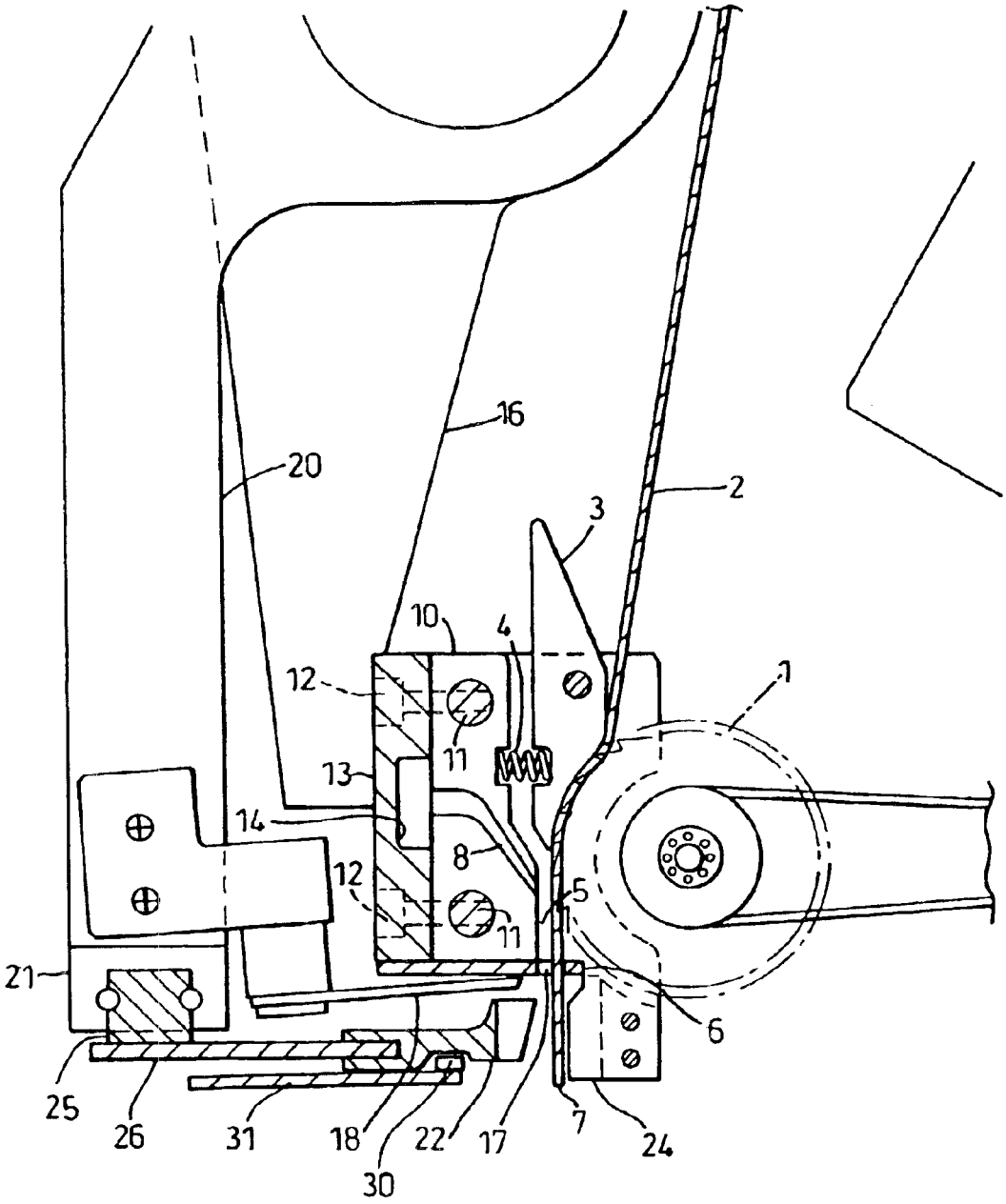
FIG. 1 is a side view of an embodiment of the yarn feeding area.

A yarn 2 is pressed against a thin saw toothed disc 1 by a presser plate 3 (FIG. 1). The plate 3 is biased towards the disc by a spring 4. When the disc is rotated a predetermined angle, it feeds the yarn 2 through a tunnel 5, passed a stationary cutter plate 6 to a rest position 7. To keep the yarn straight, a jet of air flows through a recess 8 and down the tunnel.

Figure 4:
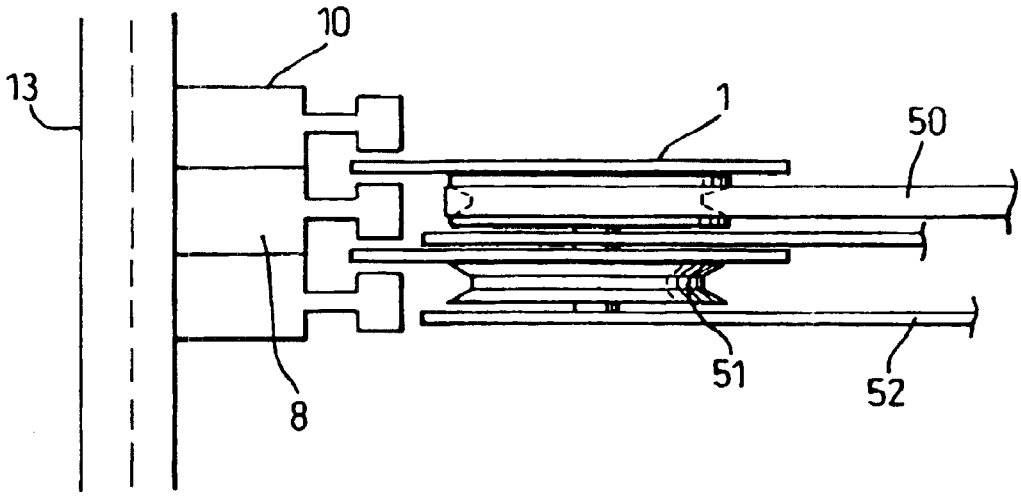
FIG. 4 is a plan view of the feeding area.

A plurality of yarns can be fed in this manner by rows of feed units, arranged in line as illustrated in the plane view FIG. 4.

The body of the feed area consists of a series of blocks 10 with recesses 8 along one edge, held together by rods 11. They are fastened to a block (FIG. 4) by screws 12 which thread into the rods 11. A duct 14 distributes the air to the recesses 8. The unit is held in place by brackets 16 which are fixed to block 13.

Figure 2:
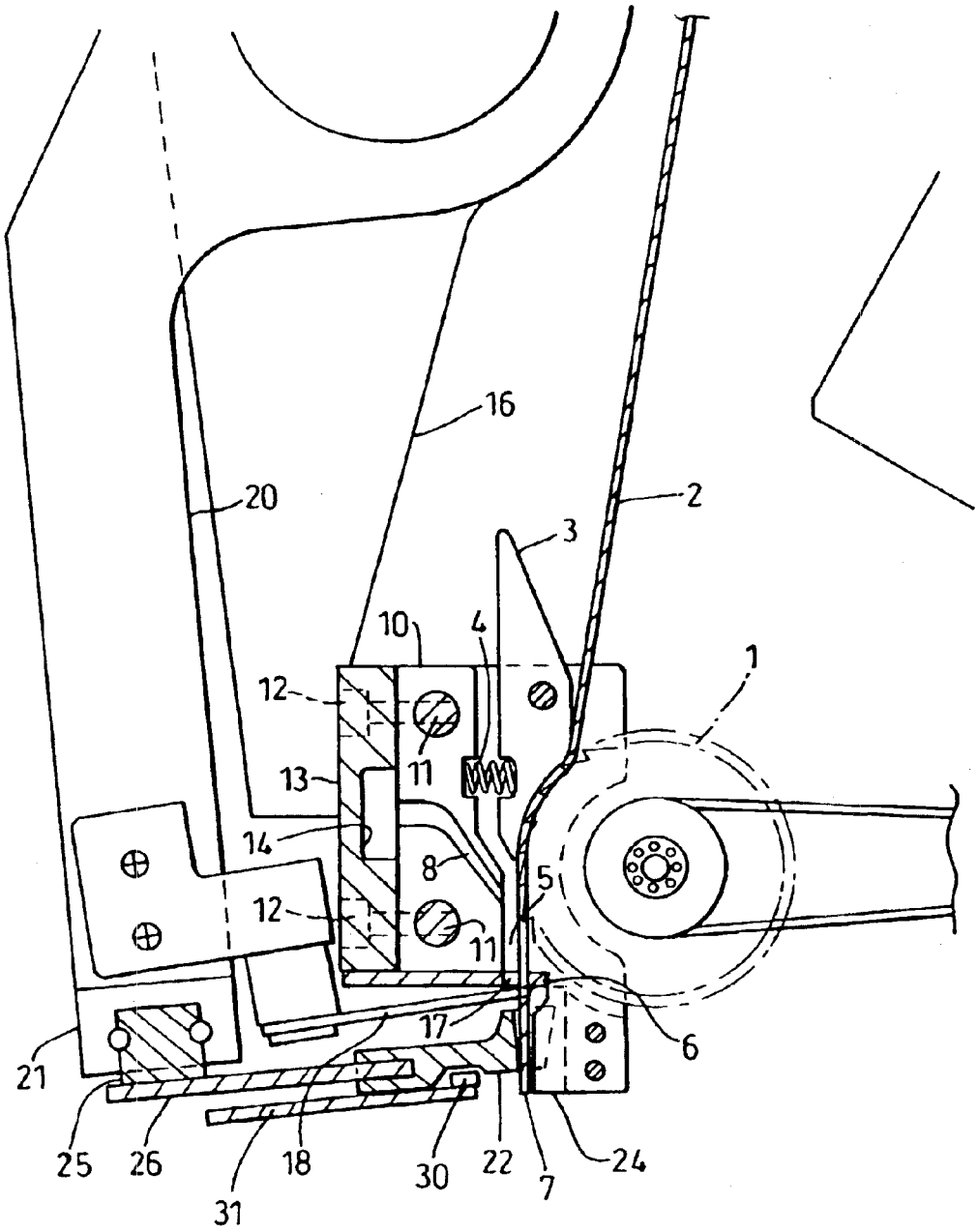
FIG. 2 is another side view of the yarn feeding area, with the cutter and carrier in their closed position.
Figure 5:
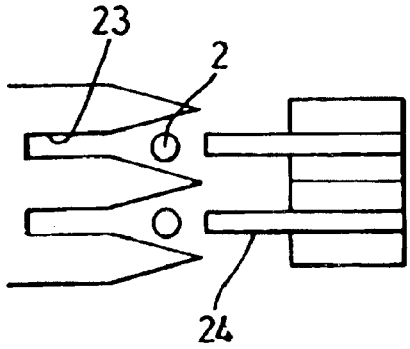
FIG. 5 is a plan view of the carrier and anvils.

The stationary cutter blade 6 has holes in it 17 for passage of the yarn. A moving blade 18 presses against the stationary blade and after a length of yarn is fed, it is moved forward, and by a scissor action, cuts the yarn (FIG. 2). The cutter is fastened to the same arm 20 as the carrier mounting 21. The carrier 22 has cut in its lots 23 to hold the yarns (FIG. 5). When the carrier moves forward with the cutter blade, the anvil 24 pushes a yarn 2 in to the slot.

As previously described in EP 0 759 101 B1 the carrier assembly slides on linear slides 21. The assembly consists of a rail 25, mounting plate 28 and carrier 22. Optionally the presence of a tuft may be detected by an opto switch 30 (FIG. 1) mounted on a circuit board 31. The opto switch beams light against the shiny front edge of the anvil which is detected if no yarn is detected.

Figure 3:
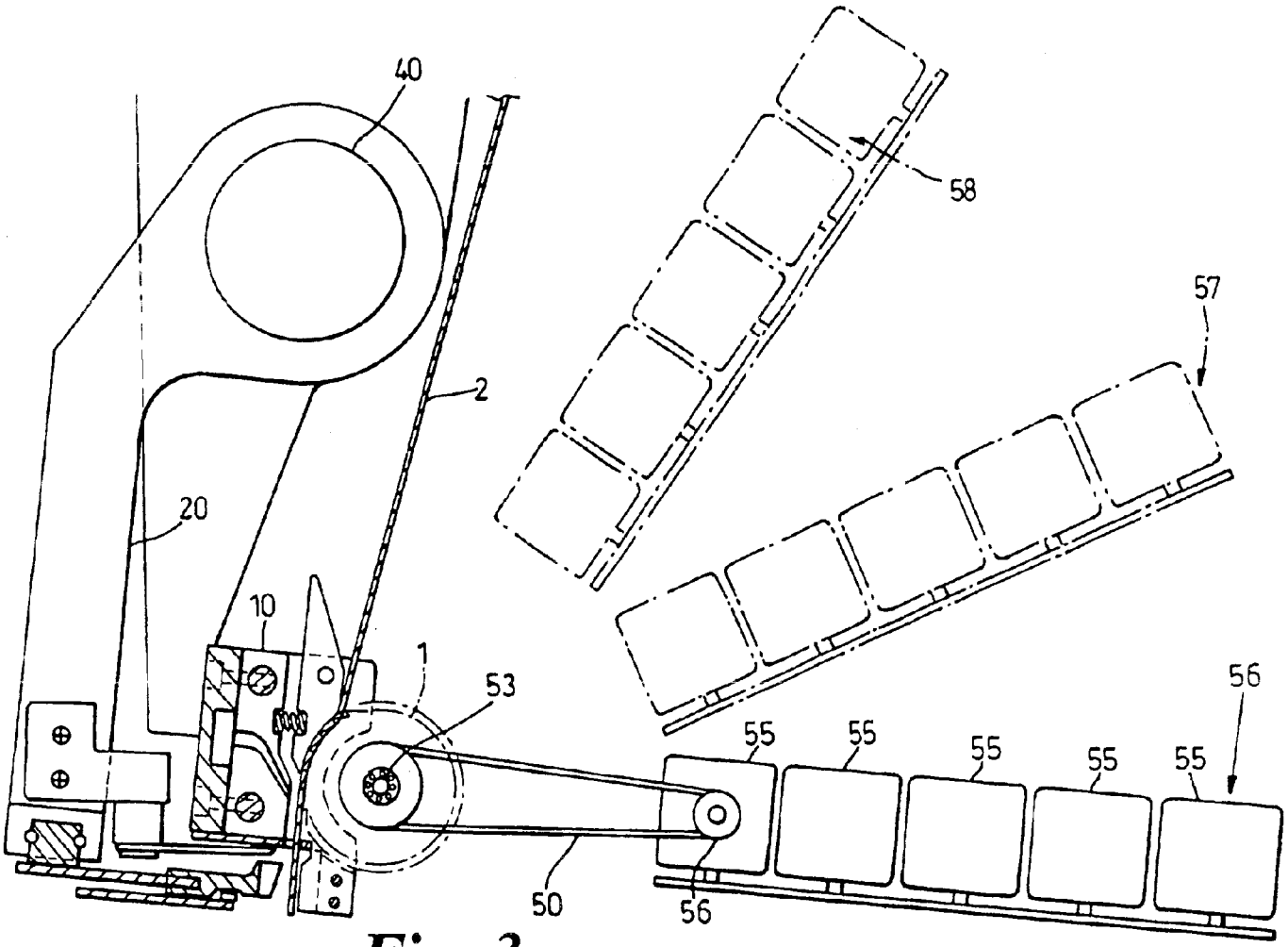
FIG. 3 is a side view of the whole device.

The carrier and moving cutter assembly is pivoted via arm 20 at shaft 40 (FIG. 3).

The discs 1 may conveniently be driven by belts 50 (FIG. 3) which drive pulleys 51 attached to the discs. Bearings 53 mounted in the pulleys are held by plates 52. Motors 55 drive the belts via pulleys 56. In order to find space for the motors they may be mounted in banks 56, 57 and 58.

What is claimed is:

1. A tuft forming mechanism including a yarn feed mechanism and a yarn severing means, the yarn feed mechanism including a passage along which yarn is guided to said yarn severing means an intermittently rotatable feed disc which engages the yarn to advance the yarn along the passage, means being provided to direct a stream of air along said passage to maintain the yarn straight, and a tuft carrier into which tufts are deposited, the tuft carrier having slots to receive a tuft and being movable toward an anvil for pushing a tuft into each slot.

2. A mechanism according to claim 1 wherein said feed disc is a toothed disc.

3. A mechanism according to claim 1 including a presser plate opposed to said disc, the presser plate being biased toward the disc to press a yarn against said disc.

4. A mechanism according to claim 1 wherein said severing means includes a static cutter plate located at an end of said passage, and a movable cutter blade.

5. A mechanism according to claim 1 wherein said feed disc is rotatably driven by an electronically controlled motor.

6. A mechanism according to claim 5 wherein said motor is a stepper motor.

7. A tuft forming mechanism including a yarn feed mechanism and a yarn severing means, the yarn feed mechanism including a passage along which yarn is guided to said yarn severing means, an intermittently rotatable feed disc which engages the yarn to advance the yarn along the passage, means being provided to direct a stream of air along said passage to maintain the yarn straight, and a presser plate opposed to said disc, the presser plate being biased toward the disc to press a yarn against said disc.

8. A mechanism according to claim 7 wherein said feed disc is a toothed disc.

9. A method according to claim 7 wherein said severing means includes a static cutting plate located at an end of said passage, and a movable cutter blade.

10. A mechanism according to claim 7 wherein said feed disc is rotatably driven by an electronically controlled motor.

11. A mechanism according to claim 10 wherein said motor is a stepper motor.

* * * * *

UNITED STATES PATENT AND TRADEMARK OFFICE

CERTIFICATE OF CORRECTION

PATENT NO. : 6,935,257 B2
DATED : August 30, 2005
INVENTOR(S) : Griffith

It is certified that error appears in the above-identified patent and that said Letters Patent is hereby corrected as shown below:

Column 1,
Line 61, change “plane” to -- plan --.

Signed and Sealed this

Eighteenth Day of October, 2005

JON W. DUDAS
*Director of the United States Patent and Trademark Office*